United States Patent [19]

Weaver, Jr.

[11] Patent Number: 4,539,776

[45] Date of Patent: Sep. 10, 1985

[54] METHODS OF AND APPARATUS FOR POLISHING AN END PORTION OF A TERMINATED LIGHTGUIDE FIBER

[75] Inventor: Frederick R. Weaver, Jr., Snellville, Ga.

[73] Assignee: AT&T Technologies, Inc., Berkeley Heights, N.J.

[21] Appl. No.: 538,064

[22] Filed: Sep. 30, 1983

[51] Int. Cl.[3] ..... B24B 25/00; B24B 1/00

[52] U.S. Cl. ..... 51/156; 51/217 R; 51/131.3; 51/283

[58] Field of Search ..... 51/216 R, 217 R, 217 P, 51/217 L, 131.3, 131.4, 131.5, 283, 149, 150, 151, 156, 157

[56] References Cited

U.S. PATENT DOCUMENTS

| | | | |
|---|---|---|---|
| 125,565 | 4/1872 | Haines | 51/217 R |
| 264,877 | 9/1882 | Heyer | 51/216 P |
| 828,563 | 8/1906 | Miller | 51/217 R |
| 3,084,486 | 4/1963 | Orciani | 51/217 R |
| 4,272,926 | 6/1981 | Tamulevich | 51/216 R |
| 4,330,965 | 5/1982 | Clark | 51/217 R |
| 4,384,431 | 5/1983 | Jackson | 51/34 E |

FOREIGN PATENT DOCUMENTS

| | | | |
|---|---|---|---|
| 464414 | 7/1951 | Italy . | |
| 940732 | 10/1963 | United Kingdom | 51/216 R |

OTHER PUBLICATIONS

S. Berger and U. Linke, "Universally Adjustable Goniometer Polishing Device", Phys. E. Sci. Instrum., vol. II, 1978, p. 1097.

*Primary Examiner*—Harold D. Whitehead
*Attorney, Agent, or Firm*—E. W. Somers

[57] ABSTRACT

An apparatus (20) is provided for polishing an end of a plug-terminated lightguide fiber so that when it is disposed together with another plug-terminated fiber within a biconical sleeve (38), there is precise end separation of opposing end portions of the fibers. The apparatus includes a holder (40) in which is disposed a plug (30) with an encapsulated end portion (31) of the fiber (23) extending from the plug. A housing (80) receives the holder and causes the plug to be seated in engagement with an insert (96) in a base (81) with the encapsulated end portion extending beyond a reference plane (94) of the base. The base includes non-wearing pads (86–86) spaced about an outer surface thereof. The holder is caused to apply to the plug a force which is equal to that which the plug will experience when mounted in the biconical sleeve. As the base is moved in an oscillatory manner in a bed of polishing slurry, the encapsulated end portion of the fiber is polished so that an end face thereof is a predetermined distance ($D_2$) from a peripheral boundary (39) of the plug. This insures that the encapsulated end portion of the fiber will be spaced precisely with respect to that of an opposing plug when mounted in a biconical sleeve.

20 Claims, 16 Drawing Figures

Fig. 1
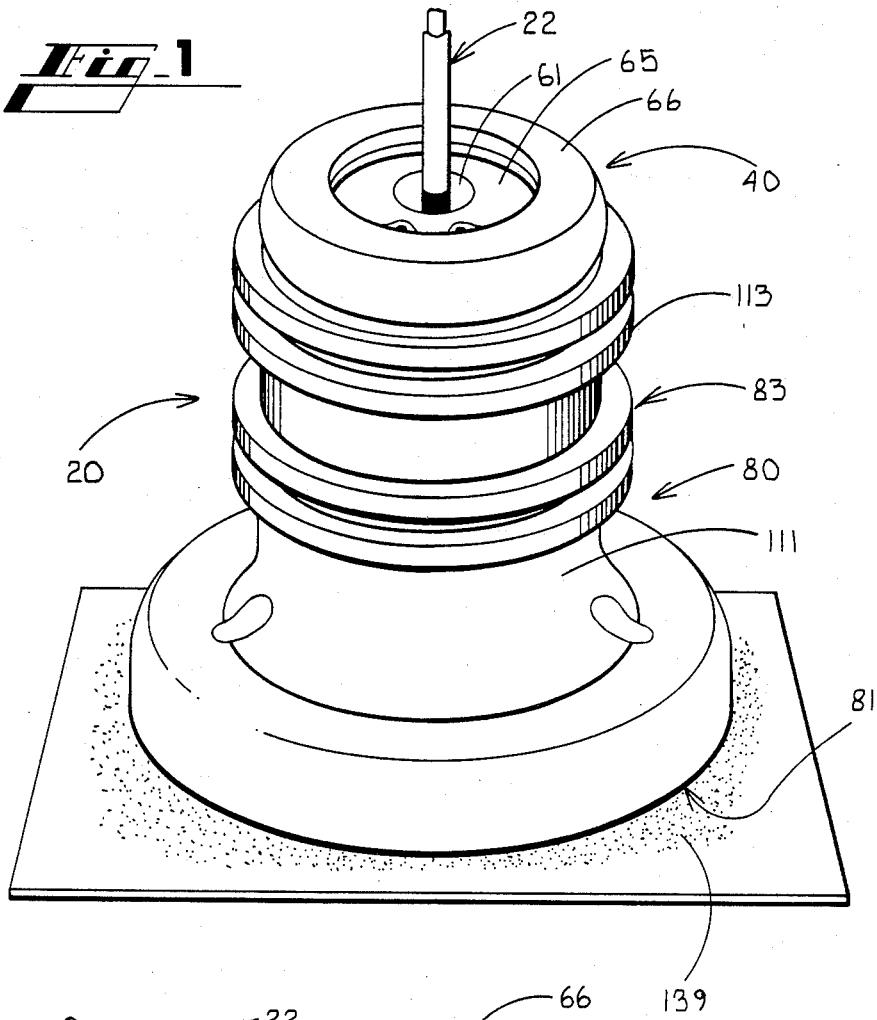
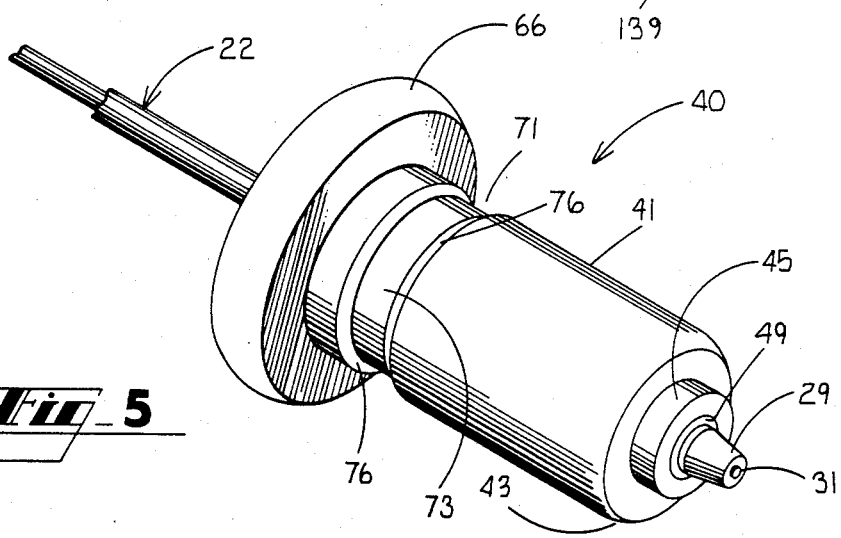
Fig. 5

Fig. 4
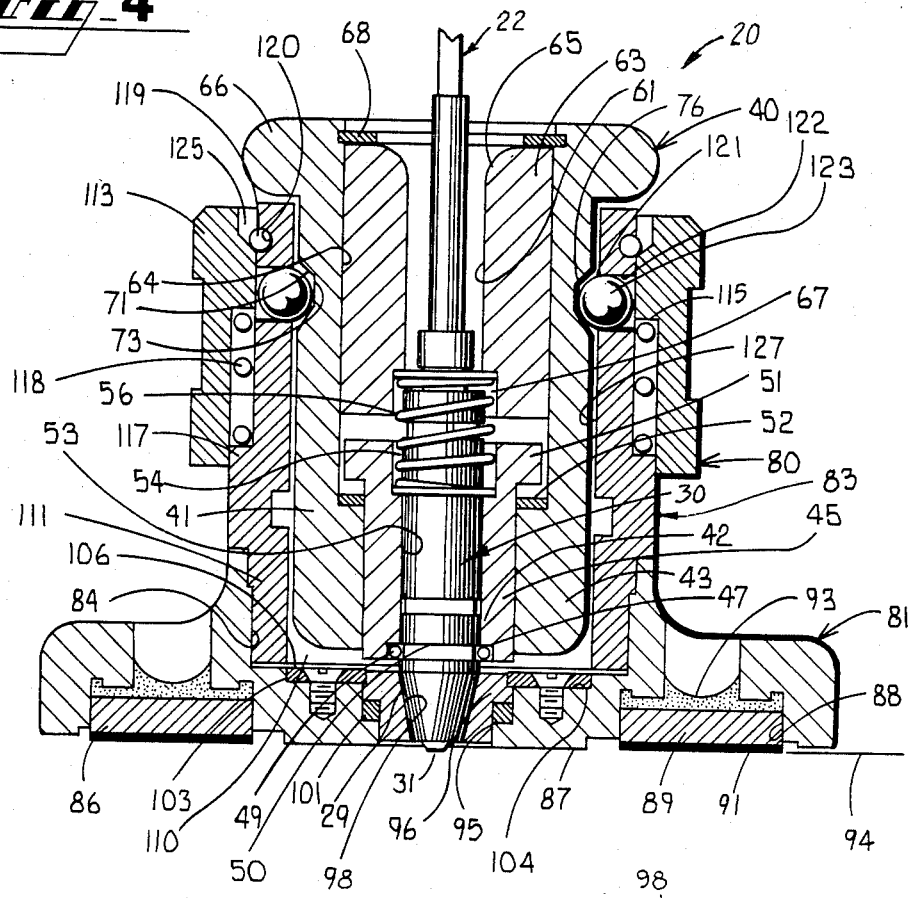
Fig. 9
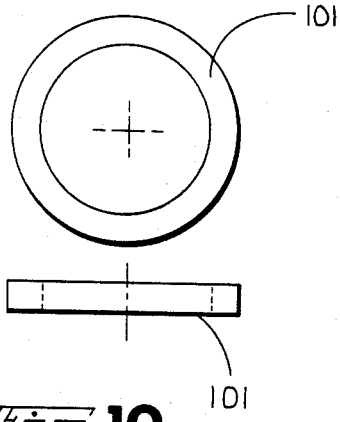
Fig. 10
Fig. 8
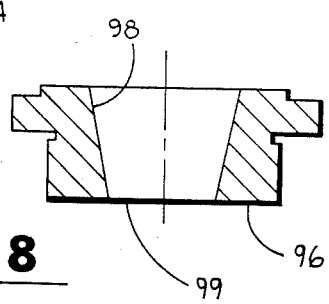
Fig. 13
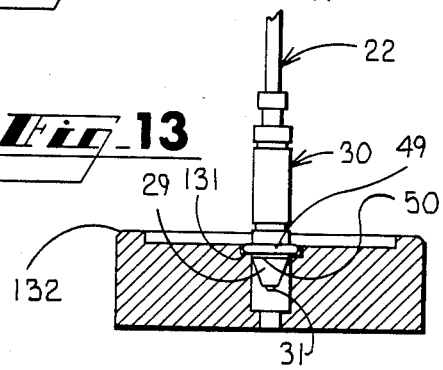

METHODS OF AND APPARATUS FOR POLISHING AN END PORTION OF A TERMINATED LIGHTGUIDE FIBER

TECHNICAL FIELD

This invention relates to methods of and apparatus for polishing an end portion of a terminated lightguide fiber. More particularly, it relates to methods of and apparatus for finishing an end portion of a plug which terminates an end portion of a lightguide fiber.

BACKGROUND OF THE INVENTION

Over the past several years, the market for optical communications systems has grown significantly. Two types of cables generally are used in optical communications. One includes a plurality of lightguide fibers which are arranged in ribbons and in arrays or stranded together, and another which is a single lightguide fiber. The single lightguide fiber cables have been used to interface electrical and optical apparatus such as, for example, regenerators and signal coders and to provide optical patch cords and jumper cables for main distributing frames.

Each of the above-described cables has its own connection technology. In making a single, fiber-to-fiber connection, end portions of the two lightguide fibers to be spliced together must be aligned coaxially such that end faces of the opposing fibers are in a predetermined relationship to each other. This is important, particularly since signal losses which are introduced by axial misalignment and end separation are synergistically cumulative.

A single fiber lightguide connector may be one such as that shown on pages 89–90 of an article by T. L. Williford et al entitled "Interconnection for Lightguide Fibers" published in the Winter 1980 issue of the *Western Electric Engineer.* The basic elements of the connector are a plastic conical plug which is molded about the end of the fiber with the fiber centered inside the plug, and a biconical sleeve which accepts two plugs and causes the alignment of the axes of the fiber ends. The biconical alignment sleeve is a precisely molded part. It includes two truncated conical cavities that control the end separation and axial alignment of the end faces of the fibers which are encapsulated within the plugs that are seated in the conical cavities of the sleeve. The circular symmetry of the conical design provides precise axial alignment of the lightguide fiber cores.

Interconnection requires that the ends of the lightguide fibers be smooth, flat and perpendicular to the lightguide fiber axes and the lightguide fiber axes to be coincident with those of the plugs and the biconical alignment sleeve. Also, each plug must be sized precisely to control plug end separation within the biconical alignment sleeve. When the plug is molded about the fiber, a portion of the fiber extends beyond an end face of the plug.

To obtain the required end separation and geometry of the end faces of the opposing fibers when connectorized, it becomes necessary to sever the extending end portion of the fiber and to grind, then polish the end faces of the fiber and plug to a tolerance of about 0 to 0.00150 cm. A technique for the first stage of a single fiber end preparation in which the extending portion of the fiber is removed and the end faces of the plug and fiber abraided is described in U.S. Pat. No. 4,384,431 which issued on May 24, 1983 in the name of K. W. Jackson.

Presently, the final polishing is accomplished by moving the plug into seating engagement with the wall of a tapered opening of an insert in a metal disc. An end of the plug which is to be polished extends beyond the disc. The disc is moved in an oscillatory manner in a slurry or on a pad which is coated with aluminum oxide. The plug is held manually in the insert as the disc is being moved.

This procedure presents several problems. First, the disc which is made of steel wears as it is moved about in the polishing medium. As a result, the distance between the end of the plug and the disc changes. This causes an excessive gap between ends of the fibers when two plugs are mounted in a biconical connector sleeve. Also, since the plug is held by hand in the insert, it tends to wobble. This often results in a non-flat plug end which does not satisfy the requirement of flatness within 0.00000025 micron. If the plug wobbles, it is unlikely that the end face will be perpendicular to the fiber. Lastly, when the plug is mounted in a biconical connector sleeve, a compression spring applies a predetermined force to the plug. If this same force is not applied to the plug during polishing, the plug may occupy a different position with respect to the insert than with respect to the sleeve.

There is still a need for methods and apparatus for the rapid final preparation of terminated lightguide fiber ends in a repetitively controllable fashion to facilitate the factory and/or field connectorization of single fiber lightguide cables. This need is not met by any known apparatus and while presently used techniques may be used, the elements of control and speed are lacking. Seemingly, the prior art does not include methods and apparatus for polishing an end of a plug through which a lightguide fiber extends and for causing the plug to be held during polishing in a manner similar to that in which it will be held in a biconical sleeve.

SUMMARY OF THE INVENTION

The foregoing problems involved in polishing an encapsulated end portion of a lightguide fiber, which extends beyond an end surface of a connector element that terminates the lightguide fiber, have been solved by the methods and apparatus of this invention. The connector element is supported with a surface which engages a peripheral boundary of the connector element to cause the encapsulated end portion of the lightguide fiber to extend beyond a reference plane. A predetermined force is caused to be applied to the connector element in a direction toward the reference plane to hold the connector element in engagement with the supporting surface with its peripheral boundary spaced a predetermined distance from the reference plane. The encapsulated end portion of the lightguide fiber is engaged with an abrasive material. Relative movement is caused between the encapsulated end portion of the fiber and the abrasive material while the connector element is being held under the application of the predetermined force to cause an end surface of the encapsulated end portion of the fiber to be polished and to become spaced the predetermined distance from the peripheral boundary.

An apparatus for polishing a plug, which terminates a lightguide fiber and which has an encapsulated end portion of the fiber extending from one end thereof, comprises a holder which includes a nest for receiving the plug. The nest is biased toward one end of the holder. The apparatus further includes a housing which is adapted to receive the holder and which comprises a base and inner and outer sleeves with the inner one being connected to the base. The base includes an insert for supporting the plug along a peripheral boundary with the encapsulated end portion extending beyond a reference plane through the base. The peripheral boundary is caused to be spaced a predetermined distance from the reference plane under the application of a predetermined force. In order to be able to maintain the peripheral boundary a constant distance from the reference plane during polishing, the base is provided with a plurality of non-wearing pads which engage a polishing material. The outer sleeve is moved slideably with respect to the inner to an open position to allow the holder to be received in the inner sleeve. Upon movement to a closed position, the outer sleeve is effective to cause latching facilities to bias the holder toward the insert and cause the holder to apply the predetermined force to the plug in a direction toward the base. As relative movement is caused to occur between the base and the polishing material, the encapsulated end portion of the fiber which extends beyond the reference plane is polished with an end surface thereof becoming spaced the predetermined distance from the peripheral boundary.

BRIEF DESCRIPTION OF THE DRAWINGS

Other features of the present invention will be more readily understood from the following detailed description of specific embodiments thereof when read in conjunction with the accompanying drawings, in which:

FIG. 1 is a perspective view of an apparatus of this invention for polishing a plug-terminated end portion of a single fiber lightguide cable;

FIG. 4 is an elevational view partially in section of the apparatus of FIG. 1 together with a plug-terminated end portion of a lightguide fiber cable held therein;

FIG. 5 is a perspective view of a holder of the apparatus of FIG. 1;

FIG. 8 is an elevational view of an insert of the apparatus of FIG. 4;

FIG. 9 is a plan view of a spacer used in the base as a seat for the insert;

FIG. 10 is an elevational view of the spacer of FIG. 9;

FIG. 13 is an elevational view of a fixture which is used to assemble an annular member to a lightguide fiber plug prior to positioning the plug in a nest of the holder;

DETAILED DESCRIPTION

Figure 2:
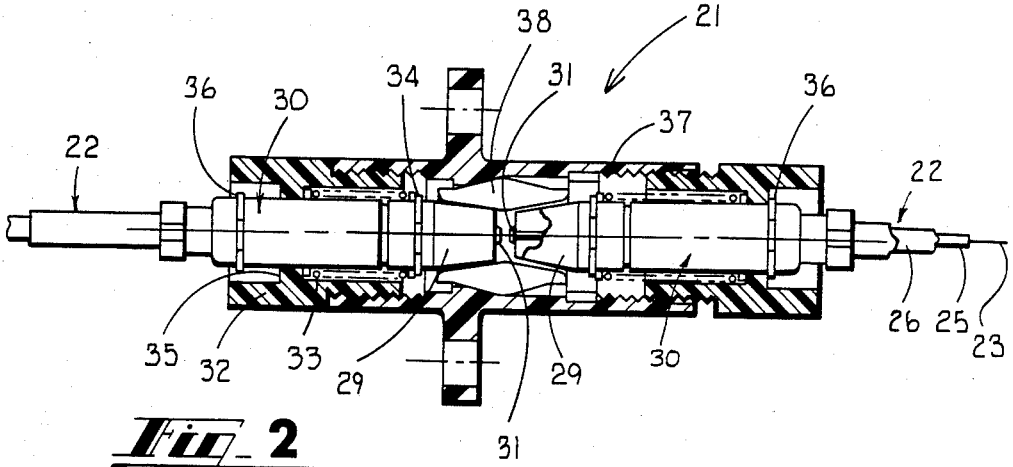
FIG. 2 is an enlarged elevational view partially in section of a lightguide fiber cable connector which is used to assemble plug-terminated end portions of two single fiber cables.

Referring now to FIG. 1, there is shown an apparatus designated generally by the numeral 20 which is a preferred embodiment of this invention and which may be used in the preparation of a single lightguide fiber connector 21 such as that shown in FIG. 2. Single lightguide fiber cables 22—22 which are spliced together with connectors 21—21 are used, for example, to interconnect between terminal devices and transmission lines.

As can be seen in FIG. 2, the lightguide fiber cable 22 includes a single lightguide fiber 23. It is enclosed in a sheath that provides mechanical protection and strength. The sheath may include inner and outer plastic jackets 25 and 26 and a strength member which is removed from an end portion of the fiber 23. A cylindrical plastic plug 30 having primary and secondary conically shaped portions 29 and 31 (see also FIG. 3A) is molded about the end portion of the fiber 23 of each cable with the fiber being centered therein. The secondary conically shaped portion 31 effectively encapsulates an end portion of the fiber 23. The plug 30 is received within an externally threaded plug housing 32. A spring 33 which is disposed about the plug between a washer 34 and an inner shoulder 35 of the plug housing biases the plug toward one end of the plug housing. A retaining washer 36 mounted on the plug 30 and disposed on an opposite side of the shoulder 35 prevents the plug from being urged completely out of the plug housing.

When connecting two single fiber cables 22—22, the plug housings 32—32 at the plug ends are turned threadably into opposite ends of a coupler 37. A biconical sleeve 38 accepts and aligns the conically shaped portions 29—29 of the two plugs 30—30. When the plugs 30—30 are turned into the coupler 37 and the leading ends of the plugs received in the sleeve 38, the springs 33—33 cause a predetermined force to be applied to the plugs. The sleeve 38 is precisely molded and controls the alignment and separation of the plugs 30—30 within the sleeve to control the axial alignment and separation of the fibers 23—23.

Desirably, the seating of the two plugs 30—30 within the sleeve 38 causes the free ends of the plugs to bottom out and to engage barely each other or to be separated slightly. In order to insure that this arrangement will avoid damage to end faces of the lightguide fibers 23—23, the plugs 30—30 must be accurately sized. Although the circular symmetry of the conical design provides precise axial alignment of the fibers 23—23, the arrangement requires precise control of the end separation of the plugs.

Figure 3A:
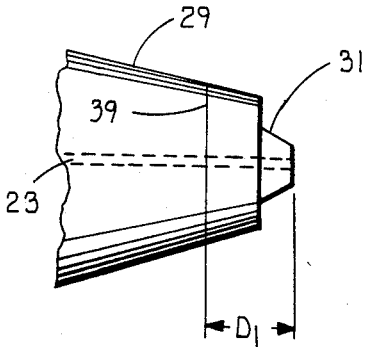
FIGS. 3A and 3B are elevational views of a portion of a plug which terminates a single lightguide fiber cable to show a particular dimension of the plug with respect to its tip and a reference boundary before and after polishing.

Viewing now FIG. 3A, it is seen that the secondary end portion 31 protrudes from the primary conical portion 29 of the plug 30. It provides the principal surface which is used during the polishing of the plug 30. When the plug 30 is molded about the fiber 23, the assembly includes about a 0.6 cm long portion of the fiber protruding from the secondary conically shaped end portion 31.

In order to insure the required end separation of the opposing end faces of the fibers 23—23, it becomes necessary to sever the protruding end portion of the fiber and then to finish it to create a planar surface in which are disposed the end surfaces of the fiber and the secondary conically shaped end portion 31. This is accomplished first by abrading the end surfaces which are formed by the severing of the fiber and of the secondary end portion 31. The plane containing their end surfaces is caused to be a predetermined distance $D_1$ of about 0.10 cm, within a tolerance of +0.00125 cm, of a peripheral reference boundary 39 on the conical portion 29 of the plug 30. Methods and apparatus which are disclosed in U.S. Pat. No. 4,384,431 which issued on May 24, 1983 in the name of K. W. Jackson are used to sever the fiber 23 and to abrade the end faces of the fiber and the secondary conically shaped portion 31.

Figure 3B:
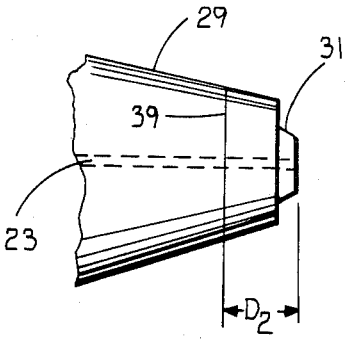

Afterwards, the end faces of the lightguide fiber 23 and of the secondary conically shaped end portion 31 must be polished to form a final plane containing their end surfaces. The final plane must be a predetermined distance $D_2$ (see FIG. 3B) of about 0.098 cm from the reference boundary 39 on the conical portion 29 of the plug 30. In this way, when the plugs 30—30 are assembled to the sleeve 38, the opposing end faces of the fibers 23—23 will be separated from each other by a distance which is within a tolerance of 0 to 0.00150 cm. Since the plug 30 is not assembled to the sleeve 38 during the polishing, the predetermined distance is measured with respect to a reference boundary of a conical surface which is an image of the surface of the sleeve and which engages with an outwardly facing surface of the primary conical portion 29 in a repeatable manner. The apparatus 20 is used to polish the plug end to achieve dimension $D_2$.

Turning now to FIGS. 1, 4 and 5, it can be seen that the apparatus 20 includes a holder designated generally by the numeral 40 for holding the plug 30 with the fiber 23 extending therefrom. The holder 40 includes a casing 41 which is made of a plastic material and which includes a moveable nest 42 that is disposed at one end 43 of the holder. A sleeve 45 in which the nest 42 is formed extends beyond the one end 43 of the holder and includes a recessed ledge 47. The recessed ledge 47 is adapted to receive an O-ring collar 49 which is made of a resilient material and which is caused to be disposed about the plug 30 in a groove 50 thereof. The opening to the ledge 47 is dimensioned to cause it to engage snugly the O-ring collar 49 which becomes important during the seating of the plug 30 in the apparatus 20. The nest 42 has a flanged end 51 which is spaced from a step 52 of the casing. Further, the nest 42 includes a passageway 53 which communicates with the end 43 and with an enlarged cavity 54 at the flanged end 51. A spring 56 is disposed within the cavity 54 of the holder 40 and has an inner diameter which is greater than the outer diameter of the plug 30.

When a plug 30 is disposed within the sleeve with its O-ring collar 49 seated in engagement with the ledge 47, the cable 22 which the plug terminates extends through the passageway 53. The passageway 53 is aligned with a passageway 61 of a spacer 63 which is slideably disposed in a cavity 64 of the casing 41. The passageway 61 communicates with an enlarged opening 65 in the spacer 63 adjacent a flanged end 66 of the holder. The other end of the spring 56 is received in an enlarged portion 67 of the passageway 61. The spacer 63 is maintained within the holder 40 by a snap ring 68 which is received in a peripheral groove of the holder adjacent to its flanged end 66.

Externally, the holder 40 has a uniform cylindrical shape except for the flanged end 66 and an annular groove 71 which is formed in the outer surface of the casing 41 adjacent to the flanged end 66. As can be seen in FIG. 5, the annular groove 71 includes an invert 73 which is concentric with a longitudinal axis of the holder 40 and side walls 76—76 which are inclined to the outer surface of the holder.

Figure 7:
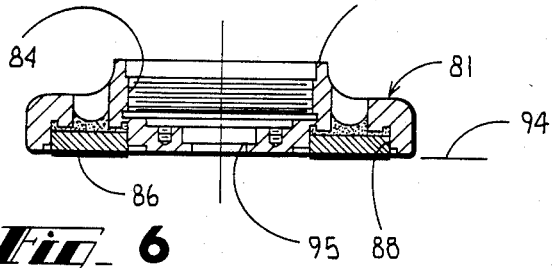
FIG. 7 is an elevational view in section of the base of FIG. 6 taken along lines 7—7.
Figure 6:
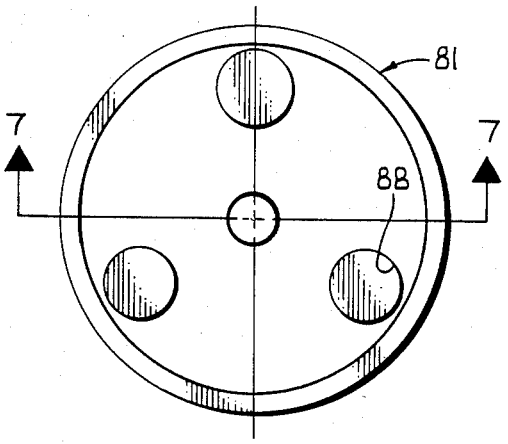
FIG. 6 is a plan view of a portion of a base of the apparatus of FIG. 1.

Turning again to FIGS. 1 and 4, there is shown a housing portion of the apparatus, which is designated generally by the numeral 80. The housing 80 includes a base 81 and a holder-receiving portion 83. The base 81 (see also FIGS. 6 and 7) has a circular cross-section and has an internally threaded opening 84 formed centrally therethrough for receiving the holder-receiving portion 83. Also, it includes a plurality of pads 86—86 of highly wear-resistant material spaced about an external radial face 87 of the base. Each of the pads 86—86 is received in a stepped cavity 88 which opens to both sides of the base 81. Each pad 86 includes a disc-like substrate 89 which is faced with a diamond-based material 91, for example, and which is held in the stepped cavity 88 by an epoxy material 93. The outer surface of each pad 86 is disposed in a common plane 94 which is referred to as the reference plane.

Figure 11:
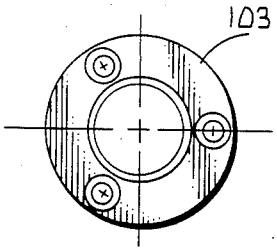
FIG. 11 is a plan view of a plate which is used to hold the insert of FIG. 8 in the base.
Figure 12:
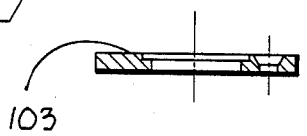
FIG. 12 is an elevational view in section of the plate of FIG. 11.

Communicating with the opening 84 in the base 81 is an opening 95 which is adapted to receive a gauging member in the form of an insert 96 (see FIGS. 4 and 8). The insert 96 has a tapered bore 98 formed therethrough with the smaller opening 99 thereof being adjacent to the radial face 87 of the base 81. The insert 96 is held in engagement with a spacer 101 (see FIGS. 9 and 10) by a retaining washer 103 (see FIGS. 11 and 12) that is received in a groove 104 formed in a surface 106 of the base 81.

The insert 96 is adapted to receive a plug 30 of a plug-terminated cable and to support it along its peripheral boundary 39. It is important that the insert 96 is situated with respect to the base 81 and is dimensioned to cause the entire primary conically shaped portion 29 of the plug 30 to become disposed within the base. Further, the insert 96 is situated in the base so that when the primary conically shaped portion 29 is received therein and seated under the application of a force equal to that of the spring 33 in the connector 21, the peripheral boundary 39 will be spaced the distance $D_2$ from the reference plane 94. The spacer 101 may be changed to change the distance $D_2$ to the reference plane. The unfinished ends of the fiber 23 and the secondary conically shaped portion 31 of the plug 30 extend slightly beyond the plane 94 past the outer surfaces of the pads 86—86 and are spaced, initially before polishing, the distance $D_1$ from the peripheral boundary 39.

As can best be seen in FIG. 4, the tapered bore 98 in the insert 96 opens to a chamber 110 of an inner sleeve 111 which is connected threadably to the base 81. The chamber 110 is designed to receive the holder 40 such that the plug 30 extends into the tapered bore 98 of the insert 96.

The holder-receiving portion 83 of the apparatus 20 includes the inner sleeve 111 which is threadably secured to the base and an outer sleeve 113 which is concentrically disposed about the inner core. As can be seen also in FIG. 4, the outer sleeve 113 includes an annular lip 115 and the inner sleeve includes an annular lip 117. Beteen these two lips 115 and 117 is disposed a compression spring 118. The compression spring is effective to bias the outer sleeve in a direction away from the base and toward an open end of the inner sleeve 113. A retaining ring 119 received in a groove 120 of the inner sleeve 111 maintains the outer sleeve 113 in engagement with the inner sleeve.

Facilities are provided for securing the holder 40 within the housing. To this end, the inner surface of the inner sleeve 111 is provided with a plurality of openings 121—121 (see FIG. 4) which are disposed about a peripheral line and which communicate with a raceway 122. A plurality of ball bearings 123—123 are disposed within the inner sleeve 111 with each having a portion received in an associated one of the openings 121—121. Each opening 121 has a diameter which is less than that of the ball bearing 123. Inasmuch as the ball bearings 123—123 are captured between the sleeves 111 and 113, they cannot become dislodged. However, the inner surface of the outer sleeve 113 is formed with a groove 125 having a sloping side wall adjacent to an inner end thereof. When the outer sleeve 113 is moved toward the base 81 against the bias of the spring 118, the groove 125 becomes aligned with the ball bearings 123—123 allowing them to be pushed outwardly radially until they are flush with an inner surface 127 of the inner sleeve.

In using the apparatus 20, an operator moves a cable 22 having a plug 30 at one end through the passageways 53 and 61 of the holder 40 and then inserts a flexible O-ring collar 49 into an annular seat 131 in a fixture 132 (see FIG. 13). Forces are applied to the plug 30 to cause the plug to move relative to the O-ring collar. This causes the O-ring collar 49 to be moved along the plug 30 until it is received in the groove 50 of the plug. Then the operator grasps the holder 40 and moves the end of the plug-terminated cable into the nest end of the passageway 53 until the O-ring collar 49 is received in engagement with the ledge 47 of the holder. At that time the plug 30 extends beyond the nest and the cable extends beyond the opposite end of the holder 40.

Then the operator holds the housing 80 and moves the outer sleeve 113 toward the base 81. Because this allows the ball bearings 123—123 to move radially outwardly, the holder 40 now may be inserted into the inner sleeve 111 with the outer surface of the holder engaging the ball bearings and causing them to be moved outwardly into the groove 125 of the outer sleeve 113.

The movement of the holder 40 is arrested when the tapered end of the primary portion 29 of the plug 30 is received in seating engagement with the tapered insert 96. At that time, the operator releases the outer sleeve 113 to allow it to be biased upwardly by the spring 118. This causes the ball bearings 123—123 to be moved out of the groove 125 in the outer sleeve 113 and to be cammed inwardly radially into the aligned groove 73 of the holder 40. As a result, the holder 40 becomes secured within the housing 80.

It should be noted that the O-ring 49 is helpful to the seating of the primary portion 29 of the plug 30 in the insert 96. Should the plug 30 not be aligned precisely axially with the insert 96, it is shifted within the O-ring to facilitate seating as the holder 40 is urged toward the base 81.

When the holder 40 is secured within the housing 80, only the secondary portion 31 of the plug 30 and fiber 23 protrude beyond the tapered insert 96 in the base 81. Further, because of the camming action of the ball bearings 123—123 on the wall 76 of the groove 73, the holder 40 is urged toward the base 81. The plug 30 is seated in the insert 96 with the conical portion 29 being supported along its peripheral reference boundary 39.

The securing of the holder 40 within the housing 80 also causes the holder 40 to apply a predetermined force to the plug 30. This force which is directed longitudinally of the fiber 23 is equal to that which is applied to the plug 30 when it is assembled in the coupler 37 (see FIG. 2). As a result, the polishing of the encapsulated fiber end will be accomplished with the plug 30 being disposed as it will be in actual use.

The predetermined force is applied to the plug 30 as a result of the cooperation among the nest 42, the spacer 63, the spring 56 and the insert 96. Once the holder 40 is secured within the housing 80, the spacer 63 is fixed with respect to the insert 96. When the holder 40 is inserted into the housing 80 and the ball bearings rendered effective to seat the plug 30 in the insert 96, the plug pushes against the nest 42 and moves it toward the spacer 63. The spring 56 is compressed thereby causing a force to be applied to the plug 30. The force is predetermined to equal that applied by the spring 33 of the connector because of the characteristics of the spring and by the distance through which the holder 40 is moved toward the base 81 when the outer sleeve is released. The tapered plug end is held in engagement with the tapered insert 96 with the predetermined force.

Hence, as the polishing proceeds, the plug 30 is being held in a tapered opening resembling that of the biconical sleeve 38 of the connector 21 shown in FIG. 2 with the same spring force that it will experience in the connector. When the predetermined force is applied to the plug 30, the peripheral boundary 39 becomes spaced the predetermined distance $D_2$ from the reference plane 94 through the pads 86—86.

The operator moves the housing in an oscillatory motion with the base 81 positioned in engagement with an abrasive bed 139 (see FIG. 1) which may comprise aluminum oxide particles. The tip of the secondary conically shaped portion 31 of the plug 30 and fiber 23 are polished until the end face of the encapsulated end portion of the fiber lies in the reference plane 94. Wear to the base 81 is prevented by the diamond-faced pads 86—86 arranged about its outer surface.

Eventually, the tip of the fiber 23 and the secondary conically shaped portion 31 will have been polished to be planar. Further, that polished end plane will be the predetermined distance $D_2$ from the peripheral boundary 39 of the plug 30 (see FIG. 3B). When two plugs 30—30, each having had its end polished, are mounted in a biconical sleeve 38, the polished tips will be spaced a distance which is within a predetermined range.

There may be occasions when the plug 30 and fiber ends must be prepolished before the final polishing step. This is accomplished by performing the steps of the method as outlined hereinbefore with the base 81 being disposed in engagement with particles of aluminum oxide. Subsequently, the process is repeated with a different particle size aluminum oxide.

Figure 14:
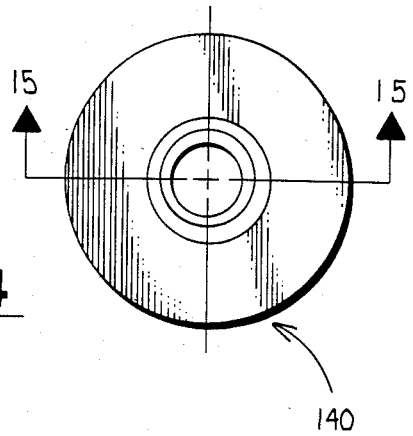
FIG. 14 is a plan view of a fixture which may be used to hold an assembled plug for polishing.
Figure 15:
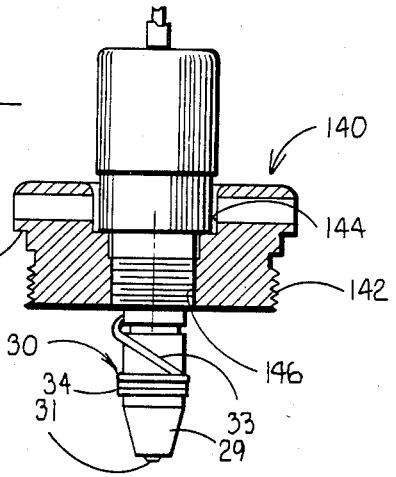
FIG. 15 is an elevational view in section of the fixture of FIG. 14 taken along lines 15—15 thereof together with a plug that terminates a single fiber cable.

Also, there may be instances when the plug 30 may require further polishing in the field. By that time, the plug 30 is disposed within a housing 32 and biased outwardly under the influence of the spring 33. After the plug 30 has been fitted with the housing 32, polishing is accomplished with a fixture 140 which is shown in FIGS. 14 and 15. Field personnel are provided with the fixture 140 and with the base portion 81, including the insert 96, of the apparatus 20. The base portion 81 has been described hereinbefore. The fixture 140 has a generally cylindrical shape with threads 142—142 formed externally thereof. Also, the fixture 140 includes a stepped opening 144 formed therethrough with a lower portion 146 being threaded.

A user assembles the fixture 140 to the base portion 81 by turning the threaded portion 142 into the threaded opening 84 of the base 81 into which the inner sleeve 111 had been received. When the fixture 140 is turned fully into the base 81, a shoulder 149 of the fixture engages a rim 151 (see FIG. 7) of the base 81. Then the user turns a threaded portion of a plug 30 containing the above-described assembly hardware into the threaded lower portion 146 until the conically shaped end of the plug is received in the insert 96. When the fixture 140 has been assembled to the base 81 and the plug housing 32 turned threadably into the opening 146, the spring 33 of the plug 30 and associated hardware apply the predetermined force to the plug which is seated in engagement with the insert 96. Then the base 81 is moved in a oscillatory manner in a bed of polishing slurry to finish the ends of the plug and fiber which extend through the insert 96.

It is to be understood that the above-described arrangements are simply illustrative of the invention. Other arrangements may be devised by those skilled in the art which will embody the principles of the invention and fall within the spirit and scope thereof.

What is claimed is:

1. A method of polishing an encapsulated end portion of a lightguide fiber which extends beyond an end surface of a conically shaped connector element that terminates the lightguide fiber and that is destined to be received in a sleeve in alignment with another connector element with the connector elements each being urged toward the other, said method including the steps of:

supporting the connector element with a conically shaped surface which engages a peripheral boundary of the connector element to cause the encapsulated end portion of the lightguide fiber to extend beyond a reference plane;

applying a predetermined force to the connector element in a direction toward the reference plane to hold the connector element in engagement with the supporting surface with its peripheral boundary spaced a predetermined distance from the reference plane, the predetermined force being substantially equal to that which is used to urge the connector element toward another connector element when the connector elements are mounted in a sleeve;

engaging the encapsulated end portion of the fiber which extends beyond the reference plane with an abrasive material; and causing relative movement between the encapsulated end portion of the fiber and the abrasive material while the connector element is being held under the application of the predetermined force to cause an end surface of the encapsulated end portion of the fiber to be polished and become spaced the predetermined distance from the peripheral boundary.

2. The method of claim 1, wherein the encapsulated end portion of the fiber is prepolished after which said steps of supporting, applying a force and causing relative movement are repeated to polish the encapsulated end portion of the fiber.

3. The method of claim 2, wherein the prepolishing is accomplished by moving the encapsulated end portion of the fiber about in a first abrasive material and the polishing is accomplished by moving the encapsulated end portion of the fiber about in a second abrasive material.

4. The method of claim 1, which also includes the step of mounting the connector element in a holder such that the connector element is movable with respect to a portion of the holder.

5. The method of claim 4, wherein the holder is mounted in a housing which applies forces to the holder to urge the connector element into engagement with the supporting surface which engages the peripheral boundary and to cause displacement of the connector element within the holder which results in the predetermined force being applied to the connector element.

6. An apparatus for polishing an encapsulated end portion of a lightguide fiber which extends beyond an end surface of a connector element which terminates the lightguide fiber, said apparatus comprising:

first support means for holding the connector element, said first support means including force-applying means capable of applying a predetermined force to the connector element in a direction toward the encapsulated end portion of the fiber;

second support means including a reference plane for holding securely said first support means and responsive to the application of the predetermined force for supporting said connector element along a peripheral boundary thereof with the peripheral boundary being a predetermined distance from the reference plane and the encapsulated end portion of the fiber extending beyond the reference plane, said second support means including substantially non-wearing means, which are disposed in the reference plane, and being effective when said first support means is held securely therein with the peripheral boundary being supported for causing said force-applying means to apply the predetermined force to the connector element; and abrading means for polishing the encapsulated end portion of the lightguide fiber which extends beyond the reference plane to cause an end surface of the encapsulated end portion to become spaced the predetermined distance from the peripheral boundary.

7. An apparatus for polishing a connector plug which terminates a lightguide fiber and which is destined to be received in a sleeve in alignment with another connector element with each connector element being urged toward the other, said apparatus comprising:

a holder which includes a moveable nest for receiving the plug which has an encapsulated end portion of a fiber extending from a conically shaped end thereof, said holder including means for causing said nest to be biased toward one end of said holder and for applying a predetermined force to the plug in said nest;

a housing which is adapted to receive said holder and to support the plug along a peripheral boundary thereof, said housing including:

a base having substantially non-wearing means mounted therein with an outer surface of said substantially non-wearing means being disposed in a reference plane, said base including conically shaped gauging means responsive to the application of the predetermined force to the plug for supporting the plug along the peripheral boundary thereof to cause the peripheral boundary to be spaced a predetermined distance from the reference plane and to cause the encapsulated end portion of the fiber to extend beyond the reference plane, the predetermined force being substantially equal to that which is used to urge the connector element toward another connector element when the connector elements are mounted in a sleeve; and inner and outer concentric sleeves, said outer sleeve being moveable between an open position and a closed position, and said inner sleeve having a cavity for receiving said holder and securing means for causing said holder to be held in said cavity of said inner sleeve, said outer sleeve of said housing being moveable to the open position to allow said holder to be received in said inner sleeve and upon movement to the closed position being effective to cause said securing means to engage and bias said holder toward said base and to cause said holder to maintain the plug in engagement with said gauging means of said base with the predetermined force; and abrading means for polishing the encapsulated end portion of the lightguide fiber which extends beyond the reference plane when relative movement is caused to occur between said abrading means and said housing to cause an end surface of the encapsulated end portion to become spaced the predetermined distance from the peripheral boundary.

8. The apparatus of claim 7, wherein said gauging means of said base includes an insert having a tapered bore defined by a wall which provides a supporting surface for an end portion of the plug, said apparatus including a collar which is made of a resilient material and which is disposed about the plug to facilitate axial alignment of the end portion of the plug with said bore of said insert when said holder is received in said inner sleeve and biased toward said base.

9. The apparatus of claim 8, wherein said holder includes a peripheral groove formed in an outer surface thereof and said housing includes a plurality of ball bearings which are receivable in openings of said inner sleeve and which are movable radially of the inner sleeve from a position where they engage said groove in said holder to a position where they are flush with an inner surface of said inner sleeve.

10. The apparatus of claim 9, wherein said outer sleeve includes a groove which becomes aligned with said ball bearings when said outer sleeve is moved toward said base to the open position to allow said ball bearings to be moved outwardly into said groove of said outer sleeve.

11. The apparatus of claim 10, wherein said housing also includes a compression spring which is disposed between a lip of said outer sleeve and a lip of said inner sleeve, said spring being effective to return said outer sleeve to the closed position and cause said outer sleeve to move said ball bearings radially inwardly into said groove of said holder and whereby said groove of said holder is formed with a sloping side wall so that when the ball bearings are moved radially inwardly they move along the sloping side wall to cam the holder toward said base.

12. The apparatus of claim 11, wherein said holder includes a casing, a first portion which includes said nest and which is spaced from said base when a plug is supported by said insert, and a second portion which is spaced from the first portion by a spring with said first and second portions being received in said casing, said second portion being in a fixed position in said casing.

13. The apparatus of claim 12, wherein the inward movement of said ball bearings causes said holder to be moved toward said base to seat the plug in engagement with said supporting surface such that said supporting surface engages the peripheral boundary of the plug and causes said first portion to be moved toward said second portion to compress said spring and cause the predetermined force to be applied to the plug.

14. An apparatus for holding a connector element, which terminates a lightguide fiber, during the polishing of the connector element, said apparatus comprising:

first support means for holding the connector element, which includes an encapsulated end portion of the lightguide fiber extending beyond one end surface of the connector element, said first support means including force-applying means capable of applying a predetermined force to the connector element in a direction toward the encapsulated end portion of the fiber; and second support means including a reference plane for holding securely said first support means and responsive to the application of the predetermined force for supporting said connector element along a peripheral boundary thereof with the peripheral boundary being a predetermined distance from the reference plane and the encapsulated end portion of the fiber extending beyond the reference plane, said second support means including substantially non-wearing means, which are disposed in the reference plane, and being effective when said first support means is held securely in said second support means with the peripheral boundary being supported for causing said force-applying means to apply the predetermined force to the connector element.

15. An apparatus for holding a connector plug, which terminates a lightguide fiber, during the polishing of the plug, said apparatus comprising:

a holder which includes a moveable nest for receiving the plug which has an encapsulated end portion of the fiber extending from one end thereof, said holder including means for causing said nest to be biased toward one end of said holder and for applying a predetermined force to the plug in said nest; and a housing which is adapted to receive said holder and to support the plug along a peripheral boundary thereof, said housing including:

a base having substantially non-wearing means mounted therein with an outer surface of said substantially non-wearing means being disposed in a reference plane, said base including gauging means rendered effective upon the application of the predetermined force to the plug for supporting the plug along the peripheral boundary thereof to cause the peripheral boundary to be spaced a predetermined distance from the reference plane and to cause the encapsulated end portion of the fiber to extend beyond the reference plane; and inner and outer sleeves, said outer sleeve being slidable relative to said inner sleeve, said inner sleeve having a cavity for receiving said holder and latching means for causing said holder to be held in said cavity of said inner sleeve, said outer sleeve of said housing being slidable to an open position to allow said holder to be received in said inner sleeve and upon movement to a closed position being effective to cause said latching means to engage and bias said holder toward said base and to cause said holder to maintain the plug in engagement with said gauging means of said base with the predetermined force.

16. The apparatus of claim 15, wherein said holder includes a peripheral groove formed in an outer surface thereof and said housing includes a plurality of ball bearings which are receivable in openings of said inner sleeve and which are movable radially of the inner sleeve from a position where they engage said groove in said holder to a position where they are flush with an inner surface of said inner sleeve.

17. The apparatus of claim 16, wherein said outer sleeve includes a groove which becomes aligned with said ball bearings when said outer sleeve is moved slideably toward said base to allow said ball bearings to be moved outwardly into said grooved of said outer sleeve.

18. The apparatus of claim 17, wherein said housing also includes a compression spring which is disposed between a lip of said outer sleeve and a lip of said inner sleeve, said spring being effective to return said outer sleeve to the closed position and cause said outer sleeve to move said ball bearings radially inwardly into said groove of said holder.

19. The apparatus of claim 18, wherein said holder includes a casing, a first portion which includes said nest and which is spaced from said base when the plug is supported by said gauging means and a second portion which is spaced from the first portion by a spring with said first and second portions being received in said casing, said second portion being in a fixed position in said casing.

20. The apparatus of claim 19, wherein the inward movement of said ball bearings causes said holder to be moved toward said base to seat the plug in engagement with a supporting surface of said gauging means such that said supporting surface engages the peripheral boundary of the plug and causes said first portion to be moved toward said second portion to compress said spring and cause the predetermined force to be applied to the plug.

* * * * *